US010012452B2

(12) United States Patent
Navred

(10) Patent No.: US 10,012,452 B2
(45) Date of Patent: Jul. 3, 2018

(54) DEVICE FOR CLOSING INNER TUBES IN A TUBULAR HEAT EXCHANGER

(71) Applicant: Tetra Laval Holdings & Finance S.A., Pully (CH)

(72) Inventor: Jenny Navred, Staffanstorp (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 364 days.

(21) Appl. No.: 14/435,844

(22) PCT Filed: Oct. 15, 2013

(86) PCT No.: PCT/EP2013/071545
§ 371 (c)(1),
(2) Date: Apr. 15, 2015

(87) PCT Pub. No.: WO2014/060426
PCT Pub. Date: Apr. 24, 2014

(65) Prior Publication Data

US 2015/0292822 A1 Oct. 15, 2015

(30) Foreign Application Priority Data

Oct. 17, 2012 (SE) ..... 1251182

(51) Int. Cl.
*F28F 9/02* (2006.01)
*F28F 9/26* (2006.01)
(Continued)

(52) U.S. Cl.
CPC ..... *F28F 9/026* (2013.01); *F28F 9/0282* (2013.01); *F28F 9/26* (2013.01); *F28F 13/06* (2013.01);
(Continued)

(58) Field of Classification Search
CPC ..... F28F 9/026; F28F 9/0282; F28F 2220/00; F28F 19/002; F28F 9/26; F28D 7/16;
(Continued)

(56) References Cited

U.S. PATENT DOCUMENTS 4,558,734 A 12/1985 Wolfseder
5,148,858 A 9/1992 Ovretveit
(Continued)

FOREIGN PATENT DOCUMENTS

EP 2607833 A1 * 6/2013 ..... F28F 9/0265
FR 2714963 A1 7/1995

OTHER PUBLICATIONS

International Search Report (PCT/ISA/210) dated Feb. 6, 2014, by the European Patent Office as the International Searching Authority for International Application No. PCT/EP2013/071545.
(Continued)

*Primary Examiner* — Hung Q Nguyen
*Assistant Examiner* — Mark L Greene
(74) *Attorney, Agent, or Firm* — Buchanan Ingersoll & Rooney PC

(57) ABSTRACT

A device for closing at least one inner tube in a tubular heat exchanger. The device comprises a main body provided with inner tube through holes and at least one plug configured to be inserted into the at least one inner tube.

10 Claims, 5 Drawing Sheets

(51) Int. Cl.
*F28F 13/06* (2006.01)
*F28D 7/16* (2006.01)
*F28F 11/02* (2006.01)

(52) U.S. Cl.
CPC ..... *F28D 7/16* (2013.01); *F28F 11/02* (2013.01); *F28F 2200/00* (2013.01); *F28F 2220/00* (2013.01)

(58) Field of Classification Search
CPC ..... F28D 2021/0042; F16L 55/11; F16L 5/14; F16L 3/2235; F16L 37/56; F16L 39/00; F16L 55/115; F16L 55/128; A23L 3/22
USPC ..... 165/144; 285/124.1, 124.2, 124.3, 12, 285/901
See application file for complete search history.

(56) References Cited

U.S. PATENT DOCUMENTS 5,325,915 A * 7/1994 Fouts ..... F28D 1/0325 165/144
5,467,818 A * 11/1995 Buckley, Jr. ..... F28D 7/06 165/149
5,586,599 A * 12/1996 Sjostrom ..... F28D 7/16 165/143
7,011,149 B2 * 3/2006 Fujita ..... F28D 1/05391 165/153
8,234,881 B2 * 8/2012 Yanik ..... F25B 39/00 62/515
2005/0051318 A1 * 3/2005 Fujita ..... F28D 1/05391 165/178
2008/0223566 A1 9/2008 Higashiyama et al.
2010/0050685 A1 * 3/2010 Yanik ..... F25B 39/00 62/515
2010/0223937 A1 9/2010 Grabon et al.
2011/0247786 A1 10/2011 Dixon et al.
2011/0259563 A1 * 10/2011 Justl ..... F28D 7/16 165/178
2012/0118547 A1 * 5/2012 Al-Otaibi ..... F16L 55/1141 165/177
2012/0137517 A1 6/2012 Johns et al.
2012/0267086 A1 * 10/2012 Yanik ..... F25B 39/00 165/174

OTHER PUBLICATIONS

Communication pursuant to Article 94(3) EPC dated Jan. 13, 2017, by the European Patent Office in corresponding European Patent Application No. 13 786 440.1-1605. (7 pages).

* cited by examiner

DEVICE FOR CLOSING INNER TUBES IN A TUBULAR HEAT EXCHANGER

TECHNICAL FIELD

The invention generally relates to the field of food processing. More particularly, it relates to a device for a closing one or several inner tubes in a tubular heat exchanger.

BACKGROUND OF THE INVENTION

Today, companies packaging liquid food products face tough competition. The effect of this is that a high uptime for the processing equipment is necessary to stay competitive. Further, due to an increasing number of different products with different demands on the processing equipment, the processing equipment needs to be easy to modify in order to keep a high uptime.

Tubular heat exchangers are a common type of heat exchanger used for heat treating a liquid food product, such as milk and juice. In short, the liquid food product is fed through inner tubes running in a bigger pipe, a so-called shell, such that the liquid food product is heated by a heat transfer medium held within the shell. A compact design of tubular heat exchangers can be achieved by having bend pipes connecting sets of inner tubes to each other.

In order to reduce energy consumption an outgoing liquid food product to be cooled down before being stored may act as heat transfer medium. In this way, the outgoing food product to be cooled down is used for heating up an incoming food product to be heat treated in order to kill unwanted microorganisms.

Besides the advantageous compact design and the low energy consumption tubular heat exchangers can have a modular design making it possible to adapt the tubular heat exchanger for a specific product. For instance, Tetra Spiraflo™ marketed by Tetra Pak has inner tubes set held in place in the outer ends. By having this configuration, the inner tubes set may easily be removed by releasing the outer ends and pulling out the inner tubes set and thereafter be replaced by another inner tubes set. In this way an inner tubes set specifically made for a certain product can be chosen, for instance having diameters and corrugation pattern known to be suitable for the product.

Even though tubular heat exchangers of today are possible to be configured for specific products, there is a need for even further possibilities to adapt the tubular heat exchanger to specific products, particularly in ways that are quick such that a high uptime can be upheld.

SUMMARY

Accordingly, the present invention preferably seeks to mitigate, alleviate or eliminate one or more of the above-identified deficiencies in the art and disadvantages singly or in any combination and solves at least the above mentioned problems according to any one of the aspects below.

According to a first aspect it is provided a device for closing at least one inner tube in a tubular heat exchanger, said device comprising a main body provided with inner tube through holes and at least one plug configured to be inserted into said at least one inner tube.

An advantage is that the configuration of the tubular heat exchanger can easily be changed, simply by installing the device in the tubular heat exchanger.

The at least one plug may be provided with a gasket in order to provide a tight fitting between said plug and said inner tube.

Having a gasket and thereby a tight fitting provides for that the risk that a product being processed enters a closed space, formed by closing the inner tube using the at least one plug, is reduced.

The gasket may placed such that, when said at least one plug is inserted in said at least one inner tube, said gasket provides for that no gap is formed between said plug and said at least one inner tube.

If having gaps there is a risk that food residues are caught in these gaps and in worst case resulting in a food safety issue. Therefore by placing the gasket in such a way that there is no gap formed between the plug and the at least one inner tube this risk is reduced.

The gasket may placed such that, when said at least one plug is inserted in said at least one inner tube, said gasket is placed next to an outer end of said at least one inner tube.

By placing the gasket close to the outer end of the inner tube the gap between the plug and the inner tube is reduced.

The device is configured to be placed between a tube case and a bend pipe.

An important function of the bend pipe is to connect to sets of inner tubes together, providing for a more compact design. For making rebuilding and inspection easier the bend pipe is generally a small piece compared to the inner tube. Therefore, by placing the device between the bend pipe and the inner tube it is possible to benefit from the wise design of the tubular heat exchanger with bend pipes that easily can be removed and put back in place.

The device may further comprise at least one sensor placed on said at least one plug such that a leakage in said at least one inner tube can be detected.

In order to detect leakage in processing equipment it is a common approach to use holes that provide for that product or water flow down on to a floor such that leakage can be spotted. However, since the inner tube should be used for holding a liquid in some configurations holes can not be used. Instead sensors are placed on the plugs such that leakage can be detected by using for instance a leakage detector provided with an open electric circuit that is closed when water or any other product with sufficient electrical conductivity is present. Alternatively or in combination, light based sensors can be used. For instance, a light transmitter may transmit well defined rays of light and a light receiver may register the reflection of the rays and based on this it can be determined if there is water or product present in the closed tube.

Further, the device may comprise bolt openings.

In order to provide for a tight fitting between the device and the tube case they should be attached properly. By attaching by using bolts it is possible to adjust the attachment in order to provide for the tight fitting. At the same time, using bolts provides a flexible attachment solution.

The device may be made in one piece.

By having the device made in one piece there is no risk for gaps between plugs and main body, implying increased food safety.

The at least one plug may be screwed onto said main body.

An alternative to having the device made in one piece is to screw the plugs onto the main body. An advantage of doing so is that a less complex manufacturing process can be achieved since plugs and main body can be manufactured separately. Still an advantage is that the plugs and the main body may be made of different materials.

In any embodiment the device may be provided in mirrored pairs, such as to be arranged on either side of a set of inner tubes. The use of a main body enables facilitates an expedient arrangement of plugs in the correct position. Further in the embodiments where the main body is clamped between components of the heat exchanger, e.g. between a bend tube and a tube case, there is no need for complex arrangements for maintaining the position of a plug in an inner tube. One example may be that a mirrored pair of devices may provided in an isolated relationship, i.e. that the mirrored pair will not be interconnected when in use. In other words, and though not necessarily desired, a single device may be arranged at one end of a tube case without a second device being arranged at an opposing side of the tube case.

According to a second aspect it is provided a tubular heat exchanger comprising a device according to the first aspect.

A front side of a tube case of said tubular heat exchanger may be provided with a recess.

An advantage of having a recess is that an open space is formed between the tube case and the device. This may be beneficial from cleaning perspective, since the open space can be easier to keep clean compared to a gap formed between the device and the tube case. Further, the open space may be used in order to influence the flow in a way such that efficient mixing is achieved and/or such that less fouling occur and/or such that the pressure drop is reduced, thereby reducing energy consumption, and/or such that aggregation of fibers is reduced and/or such that an optimal product flow velocity is achieved.

According to a third aspect it is provided a kit of parts comprising a number of devices according to the first aspect.

An advantage is that by providing the number of devices a number of different configurations of the tubular heat exchanger can be achieved. In this way the tubular heat exchanger can for instance be optimized in terms of production volume, product, energy consumption, mixing etc.

According to a fourth aspect it is provided a method for evaluating the performance of a tubular heat exchanger, said method comprising closing at least one of said inner tubes by installing a device according to the first aspect between a bend pipe and a tube case, measuring performance in terms formation of fouling, energy consumption and/or aggregation of fibers.

Due to the easy installation of the device in the tubular heat exchanger on site tests can easily be performed in order to know how to modify the tubular heat exchanger for improved performance or how to modify for a new product or a new production volume.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, wherein:

FIG. 3 illustrates in a cross sectional view an example of an interface between a bend pipe and a tube case with a device provided with plugs placed in between.

FIG. 4 illustrates in a cross sectional view another example of an interface between a bend pipe and a tube case with a device provided with plugs placed in between.

FIG. 5 illustrates in a cross sectional view yet another example of an interface between a bend pipe and a tube case with a device provided with plugs placed in between.

FIG. 7*a* illustrates in a cross sectional view a further example of an interface between a bend pipe and a tube case with a device provided with plugs placed in between.

FIG. 7*b* illustrates in a cross sectional view yet an example of an interface between a bend pipe and a tube case with a device provided with plugs placed in between.

DETAILED DESCRIPTION OF PREFERRED EMBODIMENTS

Figure 1A:
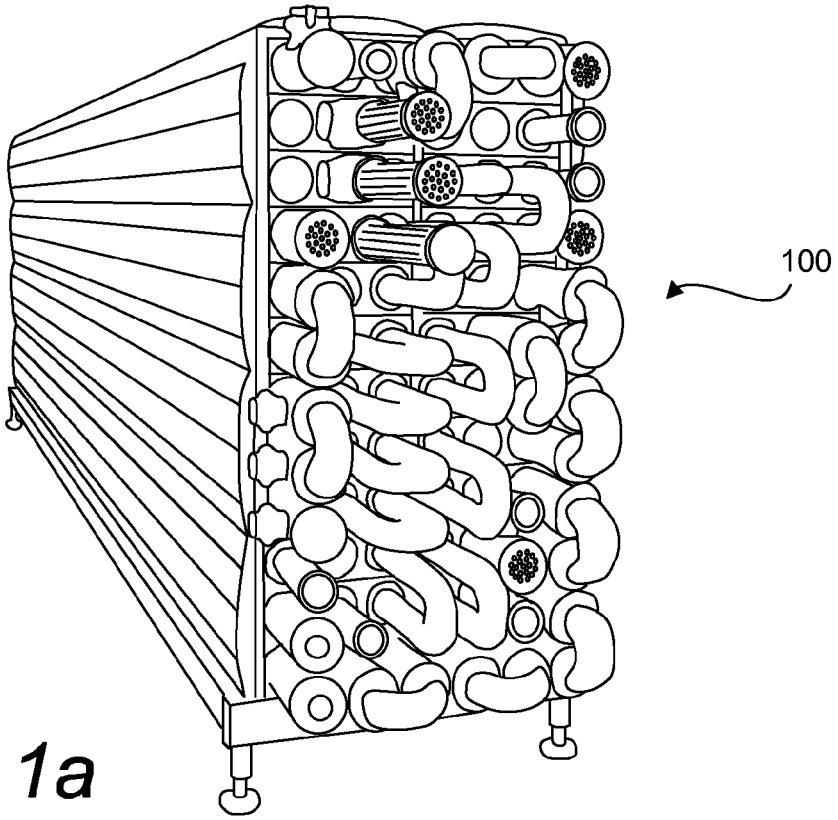
FIG. 1*a* and FIG. 1*b* illustrate an example of a tubular heat exchanger.
Figure 1B:
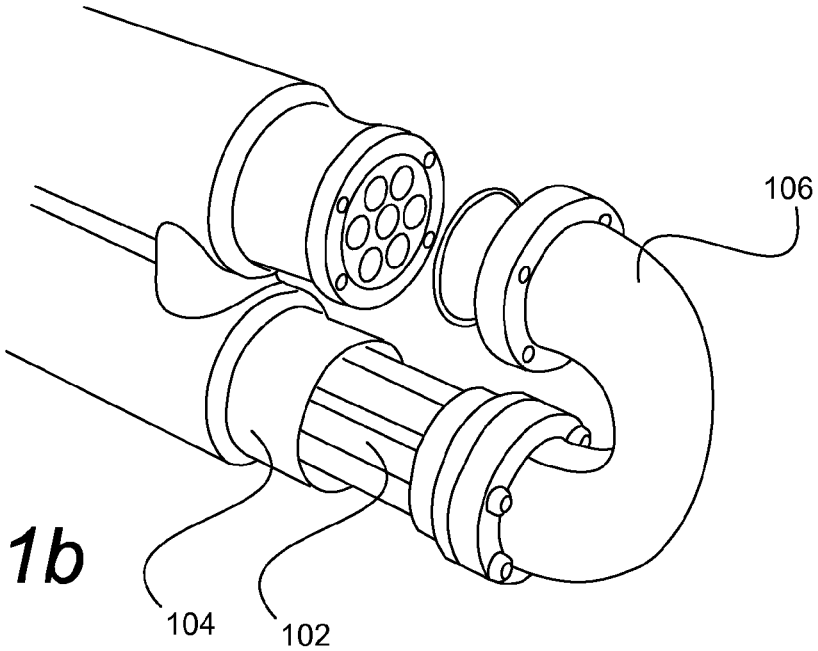

FIG. 1*a* illustrates an example of a tubular heat exchanger 100, more particularly a Tetra Spiraflo™ marketed by Tetra Pak. As illustrated in FIG. 1*b*, inner tubes 102 placed inside an outer tube 104, often referred to as a shell, are connected to each other by bend pipes 106. In this way a compact and energy efficient design can be achieved.

Figure 2:
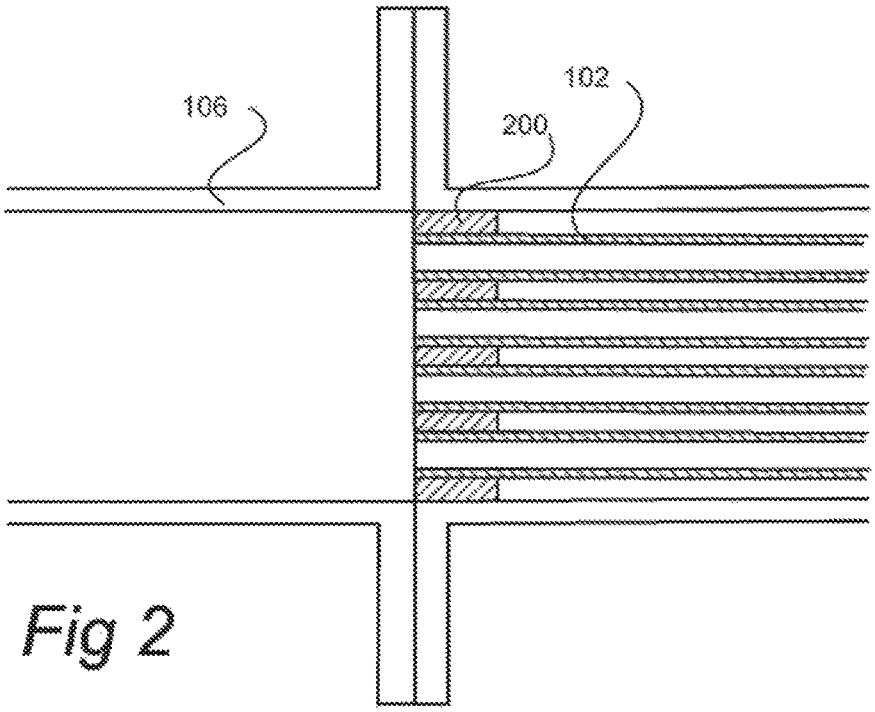
FIG. 2 illustrates an example of an interface between a bend pipe and a tube case in a cross sectional view.

In order to keep the inner tubes bundled together a set of inner tubes placed inside the same shell can be attached in each of their ends to a tube case 200 as illustrated in FIG. 2. By having the inner tubes bundled together in this way the set of inner tubes can easily be pulled out from the shell if needed for inspection or the set of inner tubes should be replaced by another set of inner tubes, e.g. because another kind of product is to be processed. Today it is a common approach to weld the inner tubes to the tube case.

Even though tubular heat exchangers are flexible in the way that the set of inner tubes can be replaced easily there is still a need to further improve the flexibility. For instance, the inner tubes have in many cases a length in the range of 3 to 6 meters, thereby requiring both space and proper equipment when replacing one set of inner tubes with another set.

Figure 3:
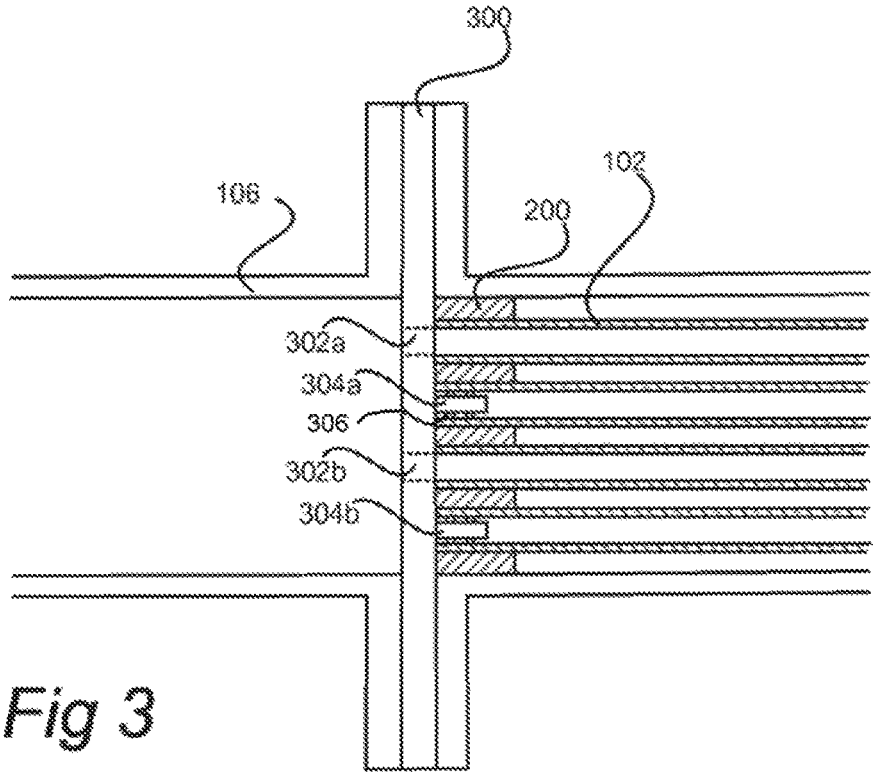

In order to improve the flexibility it is suggested to have a device 300 that can be placed between the tube case 200 and the bend pipe 106 as illustrated in FIG. 3. The device 300 can comprise a main body having through holes 302*a*, 302*b* such that product can flow through a first set of the inner tubes 102 and one or several plugs 304*a*, 304*b* arranged to be placed into a second set of the inner tubes, thereby making sure that no product is fed into this second set of inner tubes.

When one or a number of inner tubes are blocked the flow pattern may be altered. A readily appreciated result is that if a total mass flow is maintained in a lower number of tubes the fluid velocity will increase, and this will in turn change the flow pattern where individual flows meet. There will also be a direct change in an outflow or inflow pattern as a liquid enters the inner pipes depending on which pipes are blocked. These alterations of flow properties may be beneficially used when optmizing a heat exchanger for a particular liquid product. The effect of using a device in accordance with any embodiment of the invention may be evaluated by visually observing parameters such as fouling and aggregation of fibers by dismantling the device and visually observing any sign of characteristic signs, such as material build-up etc. A typical example of aggregation of fibers may be that the ends of one elongate fiber enters one inner pipe each, meaning that the fiber as such will be prevented from entering the heat exchanger. As this continues for further fibers there will be an unwanted aggregation. Other effects such as energy consumption, or energy efficiency may be monitored or measured by non-intrusive techniques, e.g. by measuring the energy consumed and relating it to a measure of the liquid processed in the heat exchanger. A method of measuring the aggregation of fibers or fouling non-intrusively may be to monitor the pressure drop over the entire heat exchanger or over a portion thereof.

As illustrated, in order to provide a tight fitting between the inner tubes and the plugs 304*a*, 304*b* one or several gaskets 306 may be used. In the example illustrated two O-rings for each of the plugs 304*a*, 304*b* are used.

An advantage of having the possibility to easily close the second set of inner tubes is that the velocity in the first set of inner tubes will be increased, which can be an advantage in case it is known for a specific product that increased velocity reduces amount of fouling.

In the example illustrated in FIG. 3, the inner tubes 102 are received in the tube case 200. In many cases the inner tubes 102 are welded to a front 5 side of the tube case, i.e. in this case a side closest to the device 300.

Figure 4:
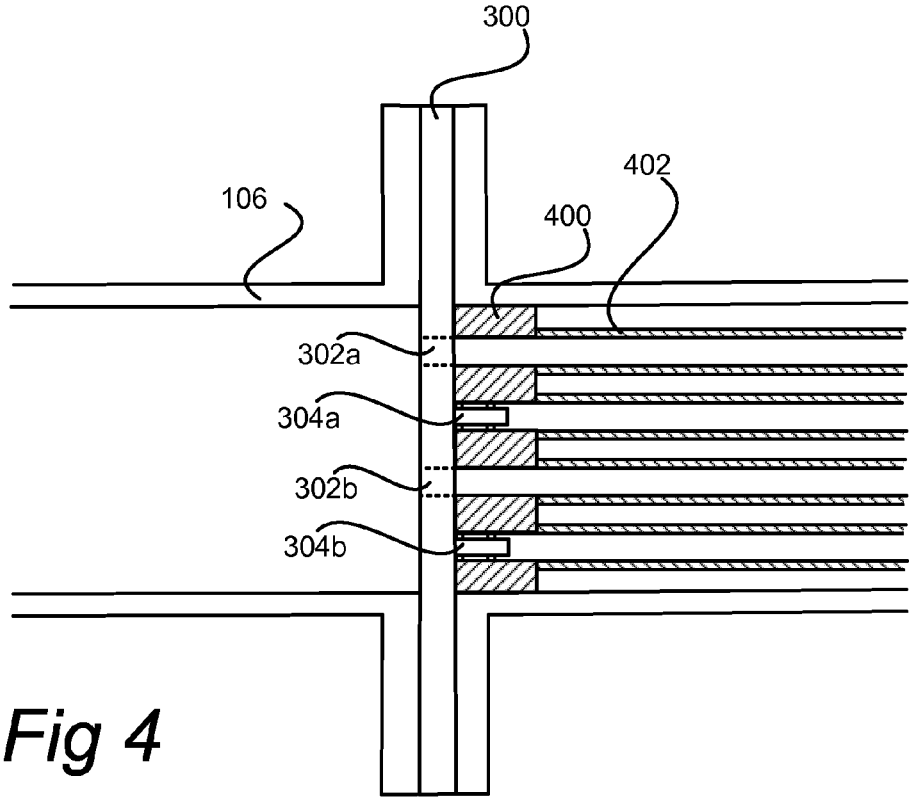

In FIG. 4 another example having an alternative arrangement of a tube case 400 and inner tubes 402 is illustrated. Unlike the example illustrated in FIG. 3, the inner tubes 402 are not received by the tube case 400, instead the inner tubes 402 are attached, e.g. by welding, to a back side of the tube case. Although not illustrated, in order to provide for an easier manufacturing process the inner tubes may be fed in a few millimeters into the tube case such that they are kept in place while attaching the inner tubes to the tube case. Herein, when attaching inner tubes to the back side of the tube case, the through holes of the tube case is considered to be part of the inner tubes.

An advantage of attaching the inner tubes to the back side of the tube case instead of in the front side is that a planar front side of the tube case 400 is achieved. This in turn implies that it is easier to provide a tight fitting between the device 300 and the tube case 400. Having a more tight fitting implies increased food safety since the risk that food residues will get caught in gaps or dead ends is reduced.

As illustrated in FIG. 4, in order to provide for a tight fitting between the plugs 304*a*, 304*b* and the tube case 400 gaskets can be placed on the plugs such that, when the plugs are inserted in the inner tubes, they are close to the outer ends of the inner tubes. Since attaching the inner tubes in the back side of the tube case provides for a more well defined edge on the front side of the tube case (since the edge is not affected by the welding), the combination of having back side weldings and gaskets close to the outer ends is advantageous.

Figure 5:
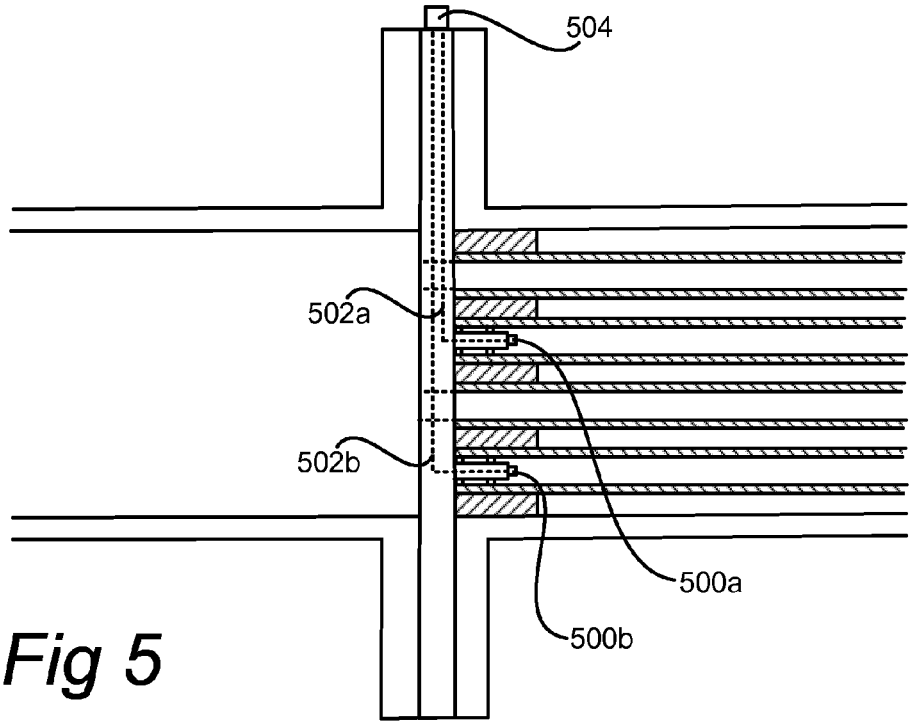

When closing an inner tube in both ends a closed space is formed. In order to make sure that there is no leakage in this closed space sensors 500*a*, 500*b* may be provided on the plugs as illustrated in FIG. 5. The sensors may be leakage detection sensors having an open circuit that is closed when water or product is present due to the electrical conductivity of water or product. Alternatively, the sensors may be light based sensors having a transmitter for transmitting light and a receiver for receiving reflected light. If there is a leakage the reflected light is affected and thus the leakage can be detected by continuously analyzing the reflected light. The transmitter and the receiver may be placed on the same plug or, alternatively, the transmitter may be placed on one plug and the receiver may be placed on the corresponding plug in the other end of the inner tube.

In order to analyze sensor signal data this may be transmitted via wires 502*a*, 502*b* or wireless to a control device 504 provided with data processing capability. Although not illustrated, the control device 504 and/or the sensors 500*a*, 500*b* may transmit data to a computer or the like placed at a remote location, e.g. a service central, using available data communications network.

Figure 6:
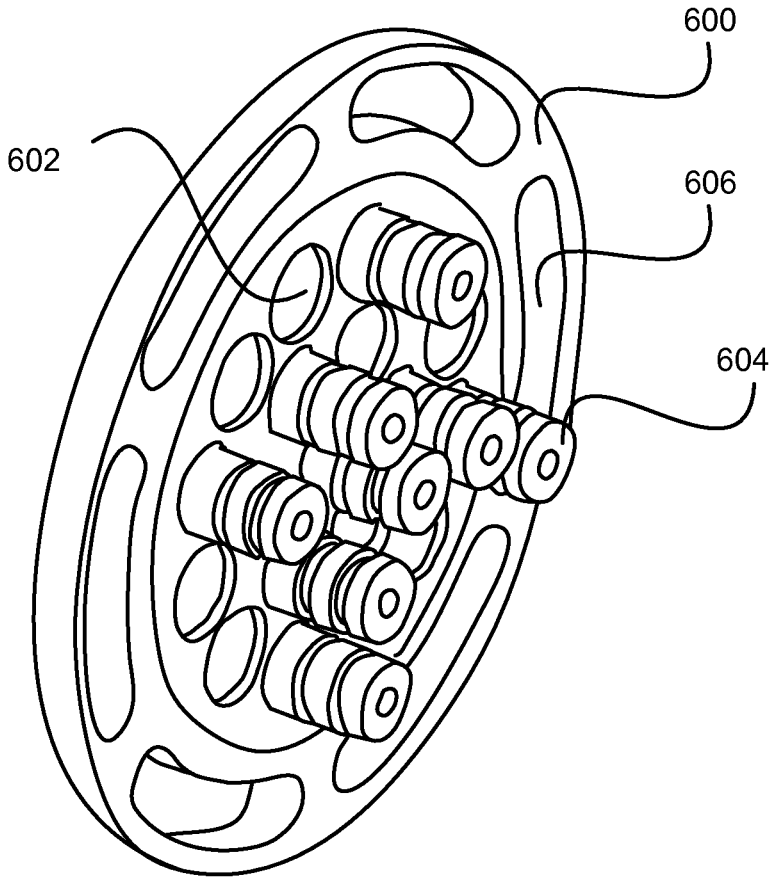
FIG. 6 illustrates an example of a device for closing inner tubes of a tubular heat exchanger.

FIG. 6 illustrates a device 600 having through holes 602, providing for that product can flow through, plugs 604 arranged to be inserted in inner tubes and bolt openings 606 providing for that the device can be fastened using bolts.

As illustrated, the plugs may be provided with gaskets in the form of O-rings providing for that there is a tight fitting with the inner tubes to be closed.

Figure 7A:
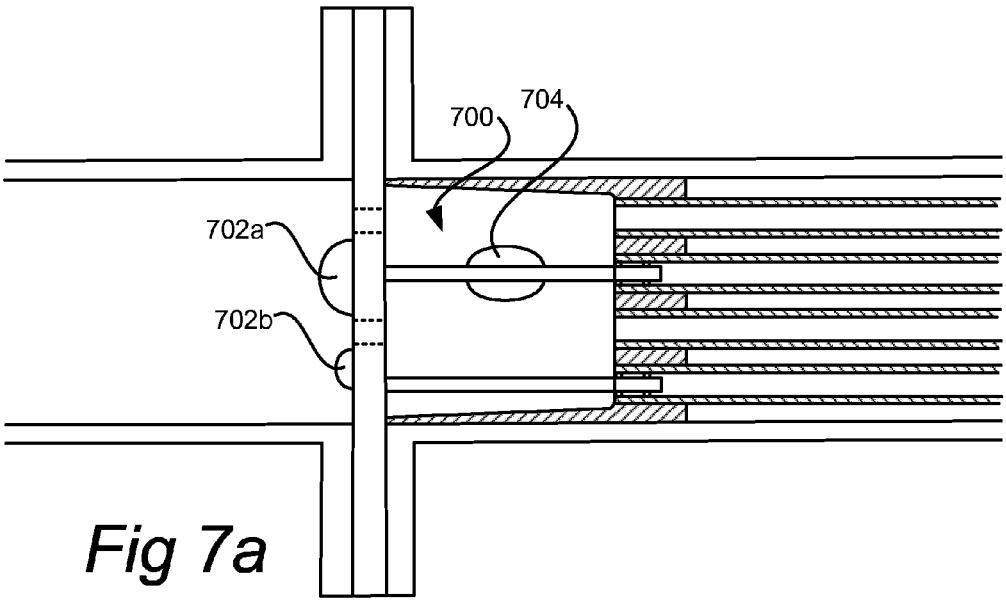
Figure 7B:
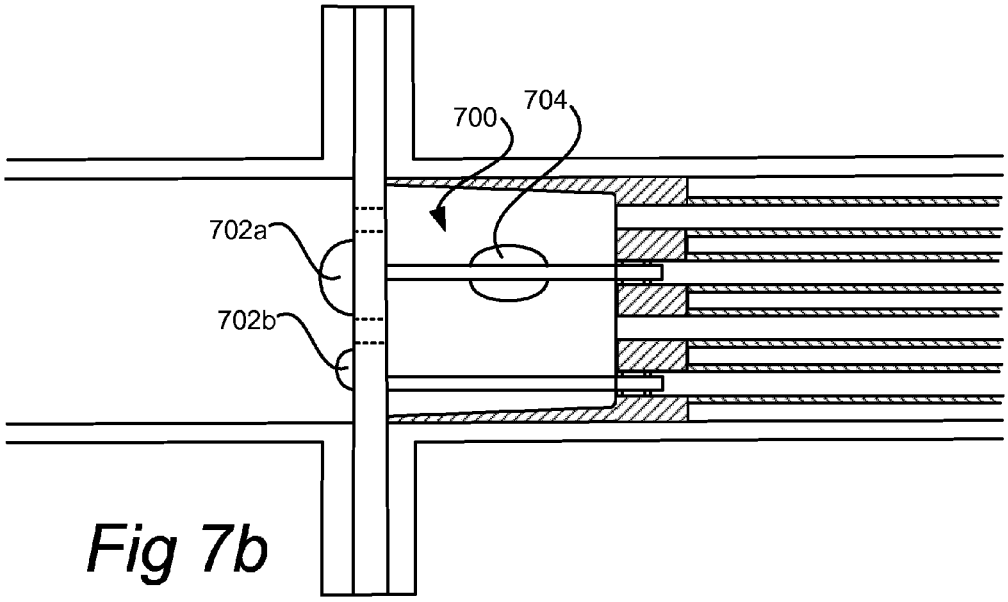

As illustrated in FIGS. 7*a* and 7*b* by examples the tube case may be provided with a recess 700 providing for that there is a space formed between the device and the tube case. By having the recess there is no small gap formed between the tube case and the device that is difficult to keep clean using available cleaning in place (CIP) technologies. Since the space is keeping the device and the inner tubes apart the through holes of the device do not have be aligned with the inner tubes. Instead the through holes in the device may be chosen in a way such that an optimal flow profile is formed. Further, which inner tubes to close and which to be keep open may also depend on the flow profile.

In order to influence the flow front side flow influence elements 702*a*, 702*b* may be provided on the device. By having these the flow may be influenced such that aggregation of fibers is reduced and/or such that a proper mixing occur and/or such that less fouling is formed. As illustrated in FIGS. 7*a* and 7*b*, the front side flow influence elements 702*a*, 702*b* may have the form of semispheres, but other forms may be used as well.

In order to influence the flow inside the space formed due to the recess 700 of the tube case, plug flow influence elements 704 may be used. The plug flow influence elements 704 may have different shapes. By having these the flow may be influenced such that aggregation of fibers is reduced and/or such that a proper mixing occur and/or such that less fouling is formed.

As illustrated in FIG. 7*a*, the inner tubes may be received via through holes of the tube case and attached in the front side. Though, as explained above and illustrated in FIG. 7*b*, the inner tubes may as an alternative be attached in the back side of the tube case.

Although not illustrated, in order to keep a tight fit between the tube case and the device a gasket may be used. Similarly, in order to keep a tight fit between the device and the bend pipe a gasket may be used. Due to that a tubular heat exchanger may easily be reconfigured by using the device mentioned above, this suits well for testing out new configurations of the tubular heat exchanger if this does not perform according to expectations or if a new product should be processed by the heat exchanger. More particularly, in order to evaluate a configuration of the tubular heat exchanger, a first step may be to theoretically determine the optimal solution in terms of open and closed inner tubes, and optionally front side flow influence elements and/or plug flow influence elements. This step may be based on simulation technology and/or test data collected beforehand.

A second step may be to choose a device according to an outcome of the first step, or to modify the device to be according to the outcome.

A third step may be to install the device in the tubular heat exchanger.

A fourth step may be to evaluate the performance of the tubular heat exchanger. The performance may be evaluated based on aggregation of fibers. This may be of interest since a reduced aggregation of fibers implies an increased running time between cleaning. The performance may also be based on fouling. This is of interest since less fouling implies increased running time between cleaning. The performance may also be based on energy consumption, since energy consumption is directly linked to cost of production. Energy consumption can be measured in terms of pressure drop.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A tubular heat exchanger comprising:

a tube case, a bend pipe, a plurality of inner tubes and a device for closing at least one of the plurality of inner tubes in the tubular heat exchanger;

said device comprising a main body provided with inner tube through holes and at least one plug; each plug configured to be inserted into one of said plurality of inner tubes to completely block flow through the one of said inner tubes, wherein said main body is clamped between the tube case and the bend pipe and is provided with bolt openings for fixing the device to the tube case and the bend pipe using bolts through the bolt openings.

2. The tubular heat exchanger according to claim 1, wherein said at least one plug is provided with a gasket in order to provide a tight fitting between said plug and said one of said plurality of inner tubes.

3. The tubular heat exchanger according to claim 2, wherein said gasket is placed such that, when said at least one plug is inserted in said one of said plurality of inner tubes, said gasket provides for that no gap is formed between said plug and said one of said inner tubes.

4. The tubular heat exchanger according to claim 3, wherein said gasket is placed such that, when said at least one plug is inserted in said one of said plurality of inner tubes, said gasket is placed next to an outer end of said one of said inner tubes.

5. The tubular heat exchanger according to claim 1, said device further comprising at least one sensor placed on said at least one plug such that a leakage in said one of said plurality of inner tubes can be detected.

6. The tubular heat exchanger according to claim 1, wherein said device is made in one piece.

7. The tubular heat exchanger according to claim 1, wherein said at least one plug is screwed onto said main body.

8. The tubular heat exchanger according to claim 1, wherein a front side of said tube case is provided with a recess.

9. A kit of parts comprising a number of tubular heat exchangers according to claim 1.

10. A method for evaluating the performance of a tubular heat exchanger according to claim 1, said method comprising closing said one of said plurality of inner tubes by installing said device between said bend pipe and said tube case, and measuring performance in terms of formation of fouling, energy consumption and/or aggregation of fibers.

* * * * *